US005191159A

United States Patent [19]

Jordan

[11] Patent Number: 5,191,159

[45] Date of Patent: Mar. 2, 1993

[54] ELECTRICAL STRINGED MUSICAL INSTRUMENT

[76] Inventor: John C. Jordan, 1173 Linden Dr., Concord, Calif. 94520

[21] Appl. No.: 620,532

[22] Filed: Nov. 28, 1990

[51] Int. Cl.[5] ..... G10D 1/02

[52] U.S. Cl. ..... 84/274; 84/291; 84/293; 84/297 R

[58] Field of Search ..... 84/306, 267, 276, 277, 84/726, 173, 274, 275, 279, 297 R, 291, 293, 268, 302, 290, 304, 295, 292; D17/14, 17

[56] References Cited

U.S. PATENT DOCUMENTS

| | | | |
|---|---|---|---|
| 2,455,575 | 12/1948 | Fender et al. | 84/726 |
| 2,933,967 | 4/1960 | Riscol | 84/726 |
| 2,978,945 | 4/1961 | Dopera et al. | 84/726 |
| 3,691,285 | 9/1972 | Larrison | 84/726 |
| 3,833,751 | 9/1974 | Chapman | 84/726 |
| 3,853,032 | 12/1974 | Freeman | D17/17 X |
| 4,235,143 | 11/1980 | Hoexter | 84/726 |
| 4,481,856 | 11/1984 | Grawi | 84/173 |
| 4,765,219 | 8/1988 | Alm | 84/726 |

*Primary Examiner*—Michael L. Gellner
*Assistant Examiner*—Howard B. Blankenship
*Attorney, Agent, or Firm*—Schapp and Hatch

[57] ABSTRACT

An electrical stringed musical instrument the machine heads of which are mounted in the body of the instrument closely adjacent the bridge with their tuning key shafts generally parallel to the upper face of the instrument and with the treble key shafts projecting from one side of the instrument, and the bass key shafts from the other. The instrument body has a lower bout only and is provided with a chinrest.

6 Claims, 2 Drawing Sheets

ELECTRICAL STRINGED MUSICAL INSTRUMENT

BACKGROUND OF THE INVENTION

1. Field of the Invention

My invention relates to musical instruments, and more particularly to electrical stringed musical instruments of the violin type, i.e., the type in which sound production is initiated by the bowing of the strings.

2. Description of the Prior Art

The term "prior art" as used herein or in any statement made by or on behalf of applicant means only that any document or thing referred to as prior art bears, directly or inferentially, a date which is earlier than the effective filing date hereof.

Electrical stringed musical instruments of the violin type are known in the prior art.

An electrical stringed musical instrument which is preferably adapted to be bowed is shown and described in U. S. Pat. No. 3,691,285, issued to Spencer Lee Larrison on Sep. 12, 1972. The electrical stringed musical instrument of this patent is provided with a head of generally conventional type, although the center line of the neck bearing the head forms an acute angle with the center line of the body in order to make the instrument more comfortable to play. The bridge of this instrument contains a plurality of electrical pickups each of which is associated with one of the five strings thereof. Each of these pickup devices is coupled to a separate preamplifier stage, each preamplifier stage is provided with its own manually operable volume control, and these preamplifier stages and their associated mixer amplifier are contained within the body of the instrument.

A simulated violoncello is shown and described in U. S. Pat. No. 4,235,143, issued to Robert S. Hoexter on Nov. 25, 1980. The pickup of this instrument is a magnetic pickup which is slidably disposed in tight-fitting relation in a rectangular slot formed in a front portion of the body just above the bridge. The head of the Hoexter instrument takes the form of an open frame through which the tuning keys pass, the outer ends of the strings being secured to their corresponding tuning key shafts.

An electrical stringed musical instrument of the "stick" type is shown and described in U.S. Pat. No. 4,765,219 which was issued to John A. Alm, on Aug. 23, 1988. As is characteristic of "stick" type violin instruments, the instrument of Alm is headless and has no bouts. Since it is completely lacking in bouts, the instrument of Alm lacks a chin rest, and instead is provided with a neckpiece which fits like a collar around the neck of the player. This neckpiece is provided with a jacket which serves as padding to make the collar comfortable and also help to position the neckpiece relative to the player's neck and shoulders. It is stated in the Alm patent that, preferably, the neckpiece fits snuggly enough about the neck of the musician so that the musician can remove his hand from the instrument and it will extend in cantilever fashion out from his neck. Alm further states that it is then possible to control the position of the instrument by upper body movement. It is evident to a person having ordinary skill in the art, however, from FIG. 1 of Alm, that any control over the position of the instrument provided by the neckpiece of Alm is in no sense comparable to that of the control provided by a chinrest of the well known type, particularly during the tuning of the instrument, when it is highly desirable that the position of the instrument be rigidly maintained without the use of the musician's hands so that the tuning keys can be manipulated efficiently and with precision.

Also, the tuning keys of Alm are back-mounted, rather than side-mounted, so that the axes of the tuning keys extend generally perpendicularly to the fingerboard, rather than generally parallel thereto, rendering the manipulation of the tuning keys more difficult than is the case with tuning keys the axes of which are generally parallel to the fingerboard.

Further, the machine heads of the instrument of Alm are so located with respect to the bridge that different strings make different angles when passing over the bridge, resulting uneven string tension from string to string, which not only creates problems in the use of the instrument by also renders difficult the use of a single piezoelectric pickup.

Yet further, it will be seen by those having ordinary skill in the art that the tuning keys of Alm are located close to the neckpiece of Alm, and remote from the bridge thereof, which makes the manipulation of the tuning keys of the instrument of Alm relatively inconvenient.

It is further to be noted that the anchoring means provided for anchoring the upper ends of the strings of the Alm instrument are so constructed and arranged that certain strings thereof assume different angles from other strings when passing over the outer bridge or nut.

It is also to be noted that in the instrument of Alm the ratio between the interbridge or bridge-to-nut distance and the distance from the bridge to the musician's neck does not correspond to that of a conventional violin, i.e., the fingerboard of the Alm instrument is located too close to the musician's body to be comfortable and easily played by a conventionally trained violinist.

A guitar-like instrument with magnetic pickup is shown and described in U.S. Pat. No. 3,833,751, issued to Emmett H. Chapman on Sep. 3, 1974. The instrument of Chapman has nine strings and is "tuned in an unique manner", so that it is not well adapted to serve as a simulated violin.

Magnetic pickups for use in electrical stringed musical instruments are shown and described in U.S. Pat. No. 2,455,575, issued to Clayton Orr Kauffman and Clarence Leo Fender on Dec. 7, 1948; in U.S. Pat. No. 2,933,967, issued to Joseph G. Riscol on Apr. 26, 1960; and in U.S. Pat. No. 2,978,945, issued to Rudolph Dopera and Edward E. Dopera on Apr. 11, 1961.

A copy of each of the above-described United States patents is supplied to the United States Patent and Trademark Office herewith.

No representation or admission is made that any of the above-discussed patents is part of the prior art, or that a search has been made, or that no more pertinent information exists.

SUMMARY OF THE INVENTION

Accordingly, it is an object of my invention to provide an electrical stringed musical instrument of the violin type which, while less bulky than a conventional violin, can be played by a violinist trained in the playing of a conventional violin with little or no alteration of playing techniques.

Another object of my present invention is to provide an electrical stringed musical instrument of the violin type which is well adapted to be tuned in the manner of conventional violins, in which the violin is clamped beneath the violinist's chin and thus the violin is stably maintained in position with both hands free for bowing and manipulation of the tuning keys.

Yet another object of my invention is to provide an electronic stringed musical instrument of the violin type wherein the tuning keys are optimally located and oriented for manipulation during tuning.

A further object of my present invention is to provide an electrical stringed musical instrument of the violin type which is so constructed and arranged that all of the strings form the same angle in passing over the bridge and all of the strings form the same angle in passing over the nut, in order to allow for the even string tension from string-to-string which is essential for using a single piezoelectric pickup for all strings.

An additional object of my present invention is to provide an electrical stringed musical instrument of the violin type in which the bridge-to-nut distance and the bridge-to-chin distance bear the same ratio to each other as the corresponding ratio found in conventional violins.

A yet further object of my present invention is to provide an electrical stringed musical instrument of the violin type wherein either ball-end or loop-end strings may be employed.

Another object of my present invention is to provide an electrical stringed musical instrument of the violin type which is well adapted for the employment of either a piezoelectric pickup or a magnetic pickup.

Other objects of my present invention will in part be obvious and will in part appear hereinafter.

My present invention, accordingly, comprises the apparatus embodying features of construction, combinations of elements, and arrangements of parts exemplified in the following disclosure, and the scope of my invention will be indicated in the appended claims.

In accordance with a principal feature of my present invention an electrical stringed musical instrument of the violin type is provided the body of which includes a bout portion and a chinrest affixed to said bout portion, whereby the player of the instrument may grip the instrument beneath his or her chin in the manner well known in the playing of conventional violins, musical instrument of my invention may be stably maintained in playing position during playing and during tuning.

In accordance with another principal feature of my present invention a bout of the musical instrument of my invention is configured in the manner of a lower bout of a conventional acoustic violin.

In accordance with another principal feature of my present invention a bout portion of the musical instrument of my invention is of the same general configuration and dimensions as a lower bout portion of a conventional acoustic violin, and is located with respect to the strings and bridge of the musical instrument of my invention as a lower bout of a conventional acoustic violin is disposed with respect to the strings and bridge thereof.

In accordance with another principal feature of my present invention the tuning keys for tuning the strings of a musical instrument thereof are disposed upon the body portion of the instrument closely adjacent the bridge, and the axes of the tuning keys are substantially parallel to the immediately adjacent portion of the upper face of the instrument.

In accordance with yet another principal feature of my present invention the machine heads of which said tuning keys are a part are affixed in bores passing through the body part of the instrument, such that the string tightening shafts thereof project upwardly from the upper surface of the instrument body closely adjacent the bridge.

In accordance with a yet further principal feature of my present invention the outer ends of the strings of the electrical stringed musical instrument of the invention are received in anchor posts affixed to the terminus of the neck of the instrument, which anchor posts are adapted to provide anchoring for either loop-end strings or ball-end strings.

In accordance with an additional principal feature of my present invention the string tightening shafts of the machine heads thereof are so located with respect to the bridge, and the string anchors are so located with respect to the nut, that all of the strings form the same angle passing over the bridge, and all of the strings form the same angle passing over the nut.

In accordance with a further principal feature of my present invention the nut-to-bridge distance and the nut-to-chinrest distance bear to each other the numerical ratio of 0.6599, as in a conventional violin.

In accordance with a further principal feature of my present invention a piezoelectric pickup is associated with the bridge thereof, and an associated amplifier is located within the body of the instrument.

In accordance with yet another principal feature of my present invention a volume control knob associated with the operation of said amplifier is disposed upon the side of the instrument body at a position closely adjacent the chinrest, and at approximately the location which would be occupied by the lower bout in a conventional violin.

In accordance with another principal feature of my present invention an output jack associated with said amplifier is disposed on the opposite sidewall of the instrument body at the outer end of the bout and near the bout-adjacent end of the chinrest.

For a fuller understanding of the nature and objects of my invention, reference should be had to the following detailed description, taken in connection with the accompanying drawings.

DESCRIPTION OF THE PREFERRED EMBODIMENT

Figure 1:
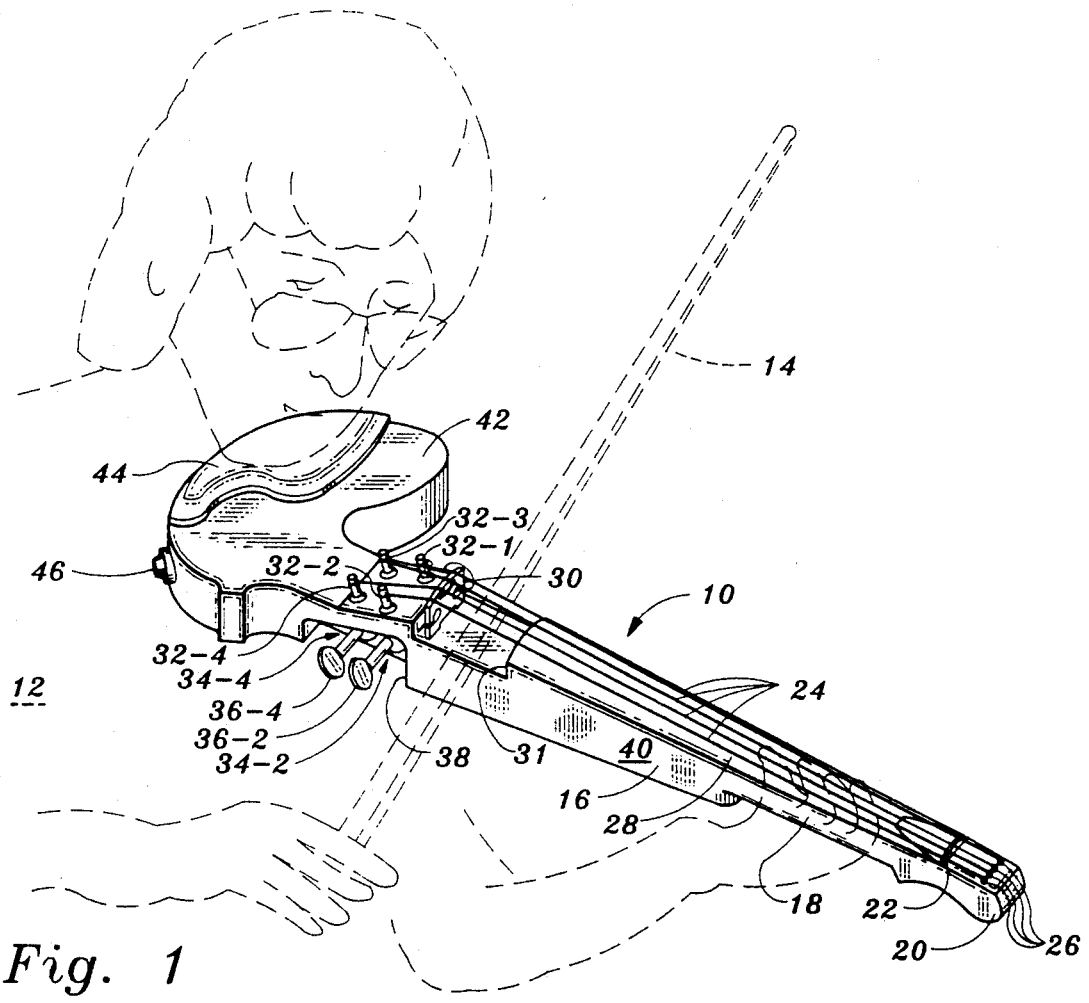
FIG. 1 is a perspective view of an electrical stringed musical instrument incorporating my present invention, showing the instrument in the usual playing position and orientation.

Referring now to FIG. 1, there is shown in perspective view an electric stringed musical instrument 10 embodying my present invention.

Also seen in FIG. 1 (in phantom) is a violinist 12 who is playing instrument 10 in accordance with the teachings of my invention, employing a conventional violin bow 14, which is also shown in phantom.

As further seen in FIG. 1, instrument 10 is comprised of two major portions, viz., a body or corpus 16 and a neck 18.

The outer portion of neck 18 is a terminus 20 upon which are mounted the nut 22 over which the outer portions of the strings 24 pass in the well known manner and the anchor posts 26 to which the outer ends of strings 24 are anchored.

It is to be noted that, in contrast with the teachings of the above-cited Alm patent, the employment of conventional string anchor posts in the instrument of the present invention makes it possible to fit the instrument with either ball-end or loop-end strings, whereas the instrument of the Alm patent is limited to the employment of ball-end strings.

As further seen in FIG. 1, the instrument 10 of the preferred embodiment of my invention further comprises a conventional fingerboard 28, which, in the known manner, overlies both the neck 18 and the outer portion of corpus 16 of instrument 10.

As also seen in FIG. 1, a bridge 30 of well known type is affixed to the central portion of corpus 16, on the bottom of a recess 31 in the upper surface of corpus 16, and the strings 24 pass over bridge 30, whereafter they are respectively secured to the string tightening shafts of associated machine heads or tuners 34. Tuners 34 may, for example, be of the type supplied under Stock No. SG-0505 by Chandler Industries of 590 - 19th Street, San Francisco, Calif. 94107, each tuner being provided with a suitable tuning key 36 as shown in FIG. 1.

In accordance with a principal feature of my present invention, the inner ends of the shafts of the tuning keys 36 for the two treble strings are located in a recess 38 which is open to the bottom and right-hand side of instrument 10, such that the shafts of these tuning keys 36 are disposed perpendicular to the right sidewall 40 of body or corpus 16, and that the manually graspable blade portions of these tuning keys 36 are located outside recess 38 for convenient manipulation by violinist 12 during the tuning of instrument 10.

Figure 5:
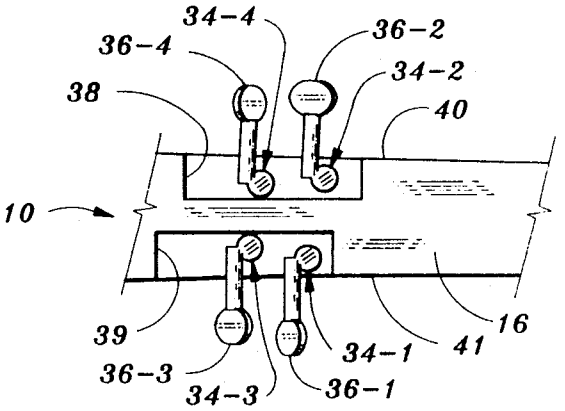
FIG. 5 is a partial view from beneath of the electrical stringed musical instrument of my invention shown in FIGS. 1 through 4, as disposed upon a horizontal surface.
Figure 3:
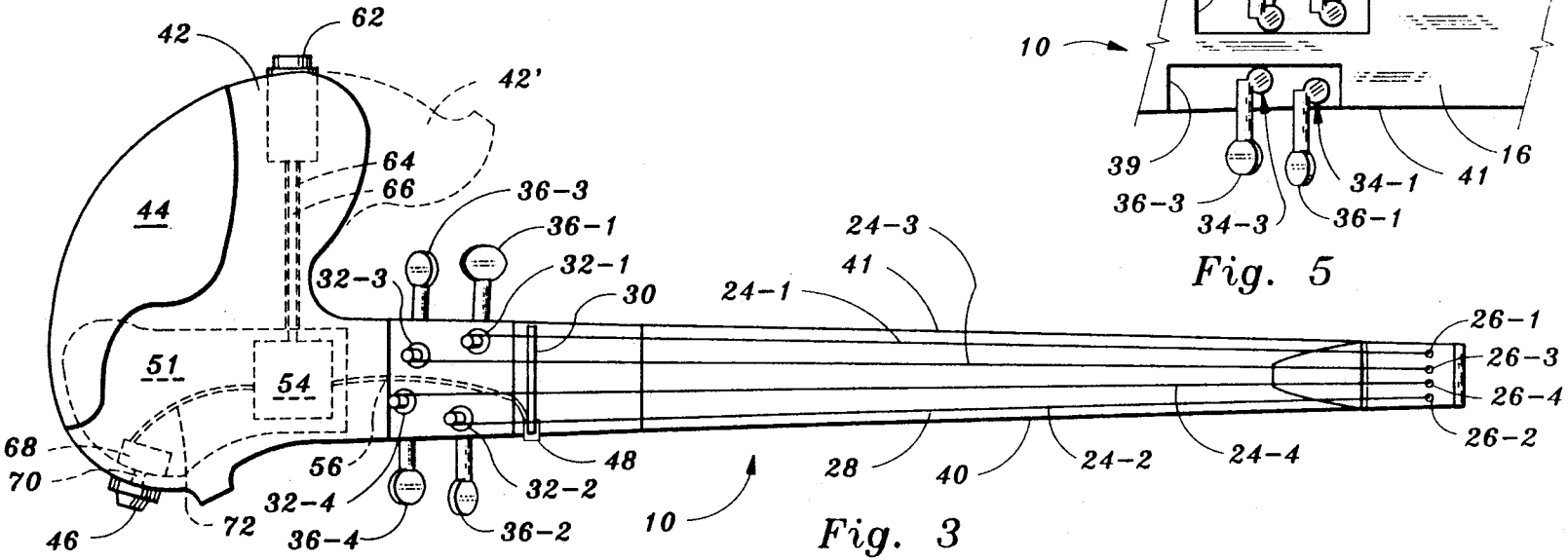
FIG. 3 is a plan view of electrical stringed musical instrument of my invention, as disposed upon a horizontal surface.

As may best be seen from FIG. 5, a recess 39, similar to recess 38 but slightly displaced with respect thereto, is provided opposite recess 38 to accomodate the two bass tuning keys 36-1, 36-3 in the same manner in which the two treble tuning keys 36-2, 36-4 are accomodated in recess 38. By this means, as best seen in FIG. 3, the bass tuning keys 36-1, 36-3 project outwardly from the left sidewall 41 of body 16 to approximately the same extent that the treble tuning keys 36-2, 36-4 project outwardly from the right sidewall 40 of body 16.

As also seen in FIG. 1, body 16 of instrument 10 of the first preferred embodiment includes a lower bass-side bout 42 similar in configuration to the bass-side lower bout of a conventional violin, but does not include any other bout. A treble-side lower bout may be included in other embodiments of my invention.

Further, the inner end of body 16 of instrument 10, adjacent the body of violinist 12, is provided with a chin rest 44 of well known type which extends over a substantial part of the upper surface of bout 42.

Returning to FIG. 1, it will be seen that the volume control knob 46 is conveniently disposed at the upper end of the right sidewall 40 of body 16, closely adjacent chin rest 44, in the approximate position which would be occupied by the treble-side lower bout in a conventional violin. Volume control knob 46 may be used to manually operate a volume control potentiometer or the like which is part of an amplifier located within an amplifier chamber or cavity in body 16, as described hereinafter.

Figure 2:
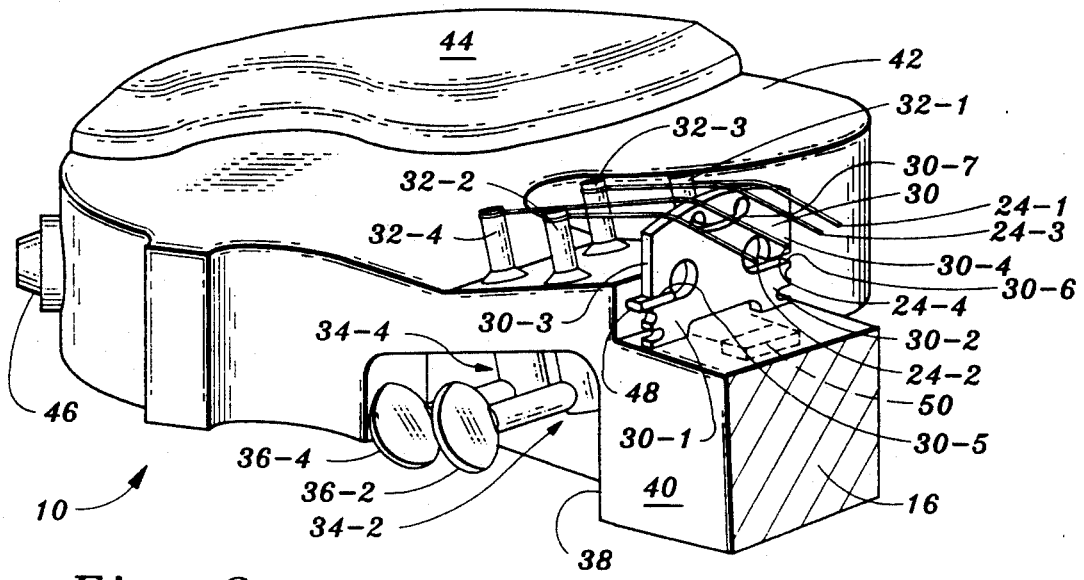
FIG. 2 is a perspective view of a part of the body portion of the electrical stringed musical instrument of FIG. 1.

Referring now to FIG. 2, it will be seen that the four strings 24 are more particularly designated by compound reference numerals, each of which includes the general designator 24 used in FIG. 1, a hyphen, and an additional numeral designating a particular string. Thus, the outer treble string (nearest the viewer in FIG. 2) is designated by the particular compound reference numeral 24-2, and the inner bass string is designated by the compound reference numeral 24-3. Thus, it will be seen that the treble strings are particularly designated by compound reference numerals having hyphenated even number suffixes, and that the bass strings are designated by compound reference numerals having hyphenated odd number suffixes.

It will also be seen in FIG. 2 that a similar convention of particular designation is sometimes employed in connection with the four tuners 34. Thus, for example, the tuner associated with inner treble string 24-4 is particularly designated by the reference number 34-4, the string tightening shaft of that tuner is designated by the particular reference numeral 32-4 and the tuning key of that tuner is particularly designated by the reference numeral 36-4.

The hyphenated suffixes are dispensed with herein when any element having a common prefix is referred to. Thus, the reference numeral 24 designates any string or all of the strings collectively.

As further seen in FIG. 2, bridge 30 is of conventional type, including two legs 30-1, 30-2, two wings 30-3, 30-4, two wing slots 30-5, 30-6, and a heart 30-7 of conventional shape.

A piezoelectric pickup 48 of well known type is frictionally disposed in treble wing slot 30-5.

Piezoelectric transducer 48 may, for example, be a piezoelectric transducer of the kind made and sold under the Stock No. V-100 by Fishman Transducers, Inc., 53 Green Street, Woburn, Mass.

As indicated in phantom in FIG. 2, a magnetic pickup 50 may be employed in certain embodiments of the invention, in lieu of piezoelectric pickup 48, or in combination with piezoelectric pickup 48.

Figure 4:
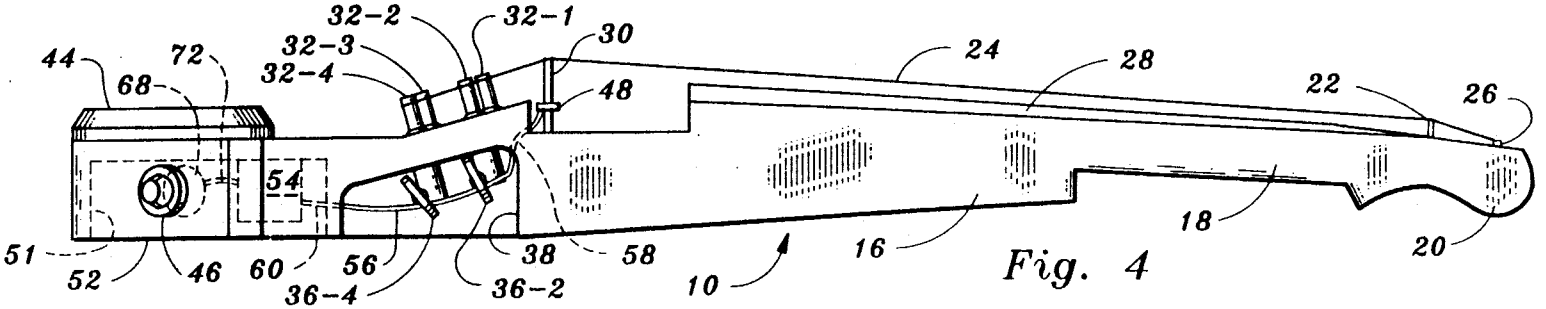
FIG. 4 is an elevational view of the electrical stringed musical instrument of my invention, as disposed upon a horizontal surface.

Referring now to FIGS. 3 and 4, it will be seen that corpus 16 of the musical instrument 10 of my invention defines a cavity 51 which opens to the lower face of instrument 10, and is covered by a suitable cover 52. Cover 52 is provided with removable and replaceable fastening means of well known type whereby it may be selectively removed from the lower face of instrument 10 for access to the means contained therein.

As may further be seen by comparison of FIGS. 3 and 4, an electronic pickup amplifier 54 is contained within chamber 51, and is secured therein.

The input terminals of amplifier 54 are provided with an electrical input signal from piezoelectric transducer 48 by means of a miniature cable 56 which extends from piezoelectric pickup 48 through a bore 58 and thus into recess 38 (FIG. 4). Miniature cable 56 extends from the lower end of bore 58, through recess 38, to a bore 60 which extends from the interior of recess 38 to the interior of cavity 51. Miniature cable 56 further extends through bore 60 into cavity 51, and within cavity 51 is connected to the input terminals of amplifier 54.

As best seen in FIG. 3, an output jack 62 is mounted in bout 42. A miniature cable 64 extends through a bore 66 in body 16, from the terminals of output jack 62 to the output terminals of amplifier 54 in chamber 51.

As will be understood by those having ordinary skill in the art, amplifier 54 may in some embodiments of my invention comprise a signal conditioning or shaping network whereby the signals produced by piezoelectric pickup 48 are suitably shaped or conditioned to optimally coact with the separate amplifier circuit which is connected to output jack 62.

As best seen in FIG. 3, there is also located within chamber 51 a volume control potentiometer 68 the shaft 70 of which is coupled to volume control knob 46 in the well known manner. Also in the well known manner, the terminals of volume control potentiometer 68 are connected to corresponding terminals of amplifier 54 by means of a miniature cable 72 (FIG. 3).

As further seen in FIG. 3, a "horn" 42' projecting outward from bout 42, may be provided in certain embodiments of my invention.

It is to be understood that in the preferred embodiment of my invention the body 16 and neck 18, including terminus 20 and bout 42 are fabricated from a single piece of wood of a kind commonly used in the fabrication of musical instruments.

It will thus be seen that the objects set forth above, among those made apparent from the preceding description, are efficiently attained, and since certain changes may be made in the above constructions without departing from the scope of my invention, it is intended that all matter contained in the above description, or shown in the accompanying drawings, shall be interpreted as illustrative only, and not in a limiting sense.

It is also to be understood that the following claims are intended to cover all of the generic and specific features of my invention hereindescribed, and all statements of the scope of the invention which, as a matter of language, might be said to fall therebetween.

What is claimed is:

1. An electrical stringed musical instrument of the violin type, comprising:

an elongated body having a first end, a second end, a first major face extending from said first end to said second end, a second major face extending from said first end to said second end, a first side extending between said first major face and said second major face, and a second side extending between said first major face and said second major face;

a neck projecting from said first end of said body;

a fingerboard overlying a part of said first major face and a part of said neck;

a bridge projecting from said first major face;

a plurality of machine heads located between said bridge and said second end of said body, each of said machine heads having a string receiving portion projecting from said first major face of said body and an associated tuning key located on one side of said body, said tuning keys being closer to said bridge than to said second end of said body; and a plurality of strings, each of said strings passing over said bridge and being attached to one of said string receiving portions;

said body including a projection extending beyond the outer ends of the tuning keys located on the same side thereof and being capable of supporting a chin rest.

2. An electrical stringed musical instrument of the violin type as claimed in claim 1 in which said tuning keys project outwardly from said sides of said body and their axes are parallel to said second major face.

3. An electrical stringed musical instrument of the violin type as claimed in claim 1 in which the transverse distance between said sides exceeds twice the maximum transverse distance between the outer ones of said strings only on the opposite side of said bridge from said first end.

4. An electrical stringed musical instrument of the violin type as claimed in claim 2 in which the transverse distance between said sides exceeds twice the maximum transverse distance between the outer ones of said strings only on the opposite side of said bridge from said first end.

5. An electrical stringed musical instrument of the violin type as claimed in claim 1 in which only one of said sides of said body projects further from the plane containing the nearest of said strings thereto than the transverse distance between said sides of said body at said bridge.

6. An electrical stringed musical instrument of the violin type as claimed in claim 2 in which only one of said sides of said body projects further from the plane containing the nearest of said strings thereto than the transverse distance between said sides of said body at said bridge.

* * * * *